United States Patent [19]

Hotine

[11] 4,364,053

[45] Dec. 14, 1982

[54] INFLATABLE STRESSED SKIN MICROWAVE ANTENNA

[76] Inventor: William Hotine, P.O. Box 216, Albion, Calif. 95410

[21] Appl. No.: 188,308

[22] Filed: Sep. 18, 1980

[51] Int. Cl.[3] ..... H01Q 15/20

[52] U.S. Cl. ..... 343/915; 343/840

[58] Field of Search ..... 343/915, 902, 840

[56] References Cited

U.S. PATENT DOCUMENTS

| | | | |
|---|---|---|---|
| 2,913,726 | 11/1959 | Currie et al. | 343/915 |
| 3,005,987 | 10/1961 | Mack et al. | 343/915 |
| 3,056,131 | 9/1962 | McCreary | 343/915 |
| 3,075,191 | 1/1963 | Peay | 343/915 |

*Primary Examiner*—David K. Moore

[57] ABSTRACT

A spherical reflector of microwaves is formed by a thin metallic coating laminated to the inside of a semi-hemispherically formed thin plastic sheet joined equatorially by a short rigid cylindrical support member to another thin semi-hemispherically formed thin plastic sheet which is transparent to microwaves. A thin wall plastic tube which is transparent to microwaves is externally joined to and extends through the cylindrical central support member at the focal plane of the reflector to provide trunnions fitting external bearings in a mounting frame to enable adjustment of antenna beam elevation angle. The interior of the trunnion tube provides support and variable positioning for the antenna feed along the focal plane for limited adjustment of antenna beam azimuth angle. The joints between the members are sealed to be airtight and the assembly is inflated to pressurize the interior and stress the hemispherical plastic skin to form a highly accurate spherical reflector and mounting with capability of adjustment of beam direction along two orthogonal axes. The construction may alternatively employ a parabolically formed reflector with the antenna feed fixed at the focal point, which requires steering the reflector assembly mounting frame for adjustment of antenna beam azimuth angle.

14 Claims, 4 Drawing Figures

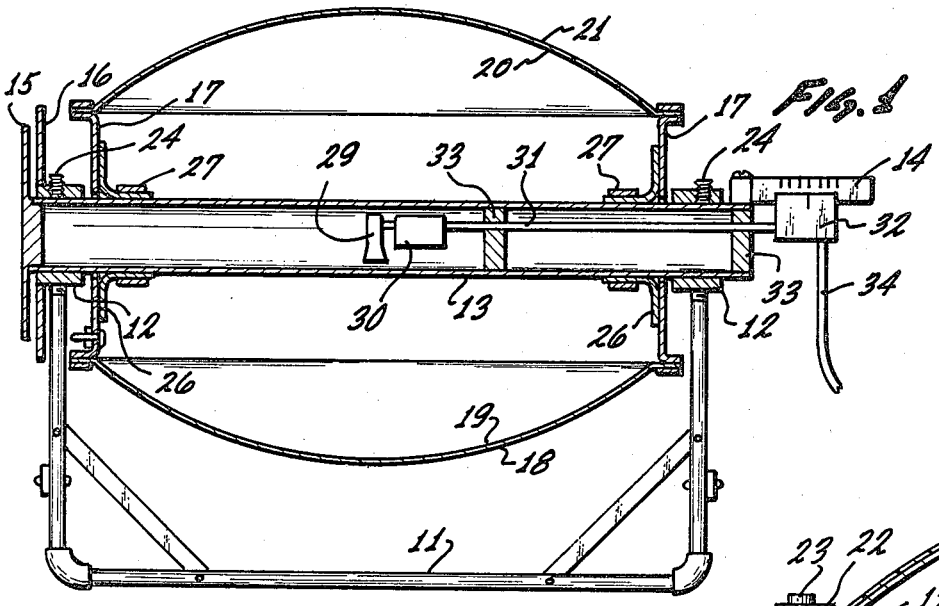
Fig. 1
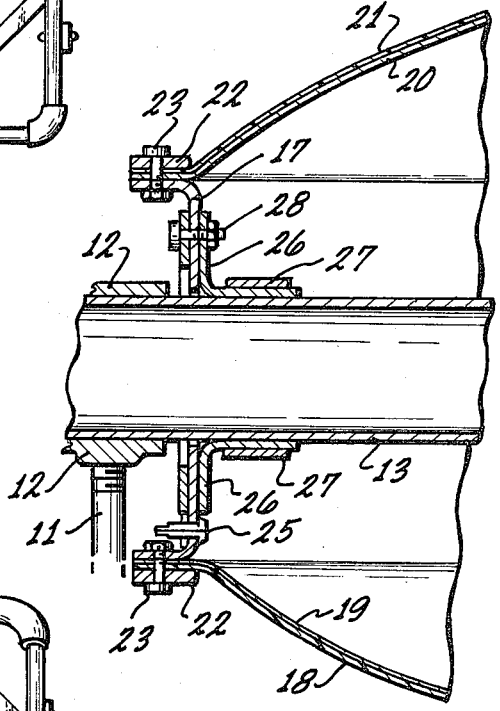
Fig. 3
Fig. 2
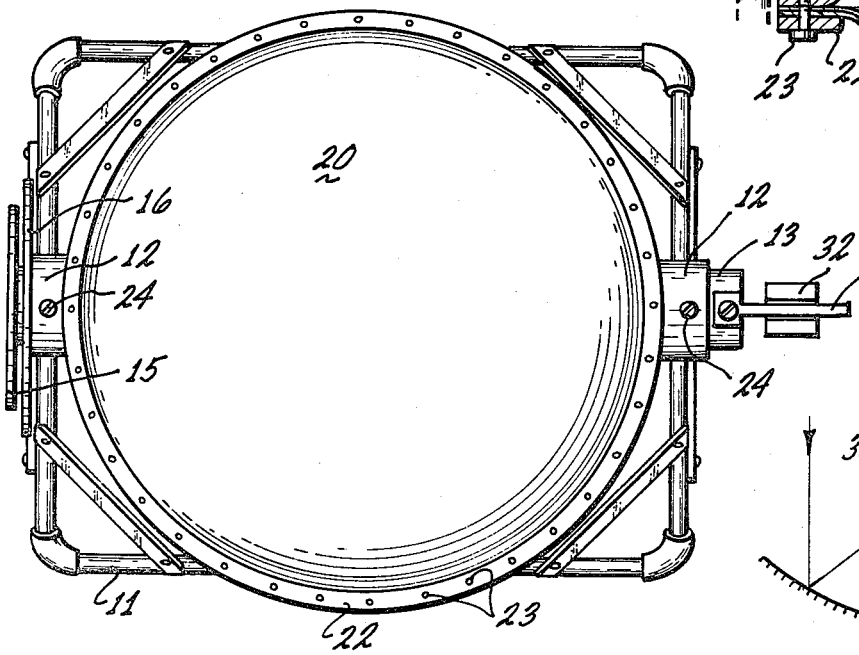
Fig. 4
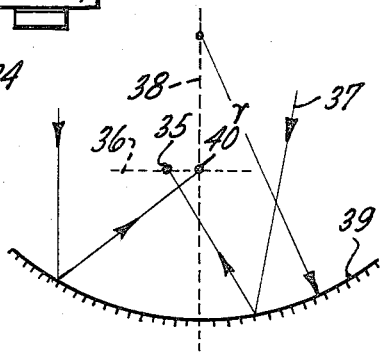

INFLATABLE STRESSED SKIN MICROWAVE ANTENNA

BACKGROUND OF THE INVENTION

Previous microwave antenna reflector assemblies have been high in cost because of the complexity of their structural design. The weight of these complex designs is large and assembly, shipment and installation is difficult and expensive. Close tolerances of parts are necessary for good accuracy and efficiency of the reflecting surface, adding to the cost. Snow and ice can accumulate on the reflector dish to degrade efficiency. Expensive servomechanisms for beam pointing are required due to the structural design and large weight supported by a pedestal mount.

The present invention largely eliminates all of the foregoing enumerated disadvantages of the previous microwave antenna art by use of a novel stressed skin inflatable construction. A hemisphere is formed by a thin metallic interior layer laminated to a formed plastic sheet and acts as the antenna reflector while a similar microwave transparent hemispherical cover is formed which enables pressurization of the interior while acting as a protective cover for the reflector, thus preventing accumulation of snow and ice on the reflector dish. A central rigid cylindrical support member for the stressed skin reflector and cover carries a microwave transparent plastic hollow trunnion tube at its central diameter inside which the antenna feed is placed. Bearings in a simple pipe support frame permit rotation of the reflector assembly on the trunnions and adjustment of antenna beam elevation. The antenna feed position can be moved along the focal plane of the reflector inside the hollow trunnion tube to permit limited adjustment of antenna beam azimuth angle with a spherical reflector, while with a parabolic reflector, the antenna feed position is at the axial focal point of the reflector inside the trunnion tube and the antenna support frame is steered for adjustment of antenna beam azimuth angle. Weight of the invention is radically reduced by the novel stressed skin construction to a fraction of the weight of previous antennas, and the reflector and cover assembly can be deflated for easy shipment. Installation is comparatively simple and easy. For point to point or geo-stationary satellite communication antenna beam pointing is sufficiently convenient. The pipe support frame is simple, with locally obtainable material. Cost and weight are radically reduced below that of the previous art while reflector efficiency is raised by the improved accuracy of the novel stressed skin construction of the reflector of present invention.

SUMMARY OF THE INVENTION

The present invention employs a novel stressed skin inflatable structure which reduces weight and cost over previous designs, provides improved surface accuracy of the reflector and also enables steering of the antenna beam elevation and azimuth angles. The present invention employs a structure in which a short central rigid cylindrical equatorial support member is joined on one end with an accurately formed stressed skin microwave reflector and on its other end with a formed stressed skin microwave transparent cover. A hollow thin wall microwave transparent plastic trunnion tube extends across the axis diametrically through the walls of the central cylindrical member and is externally joined to the walls. The projecting external ends of the plastic trunnion tube are mounted in bearings carried by a simple pipe frame so that means are provided for antenna beam elevation adjustment and locking. The microwave transparent trunnion tube is located at the focal plane of the reflector, and carries the antenna feed element in its hollow interior at the focal plane of the reflector. External adjustment of the position of the antenna feed along the focal plane can be made from the outer end of the trunnion tube by means of its stiff coaxial connecting cable. All of the joints of the reflector and trunnion tube structure are made air tight to enable inflation of the interior by pumping air through a pneumatic tire valve located on the central support member. When pressurized by inflation, the thin plastic stressed skin reflector provides a metallic interior reflector surface of very high accuracy and very low weight compared to previous complex mechanical structures. If a reflector of spherical form is used, the antenna feed element can be adjusted in its position along the focal plane to provide a limited amount of antenna beam azimuth adjustment. If a reflector of parabolic form is used, the focal point is fixed on the parabolic axis at the center of the trunnion tube and the antenna feed is located there, while the support frame must be steered to provide antenna beam azimuth adjustment. For point to point and geo-stationary satellite communications, use of the spherical reflector and movement of the antenna feed along the focal plane may be of practical use. Where greater angular steering of the beam is necessary, the parabolic reflector may be of greater practical use. The trunnion tube may have an enlarged portion at its center to provide necessary space for a remotely controlled orthogonally servo-positioned antenna feed used for remote switching of microwave signal polarization reception plane, for example, as in selecting satellite transponder channels separated by orthogonal polarization planes on the same frequency. The trunnion tube may also externally carry a servo-positioning mechanism for remotely controlling location of the antenna feed along the axis of the tube in the focal plane, for remotely swinging the antenna beam in azimuth with a spherical reflector, for example, as in steering the antenna beam to choose geo-stationary satellites which are positioned 4° apart along the plane of the earth's equator. The inflatable structure of the present invention and its low weight permit easy and simple erection and easy and low cost shipment when deflated. The microwave transparent cover serves a multiple function, excluding sunlight, rain and snow from the reflector while providing a symetrical stressed skin structure of a convex streamlined nature which reduces the effect of wind. The trunnions support the reflector assembly at its center of gravity. External wind breaks can be usefully employed to protect the antenna assembly on its frame from the effects of very high winds. These windbreaks can take the shape of a microwave transparent wall or dome surrounding the antenna, and are best suited to individual installations by judgement of all factors involved. The central cylindrical support member may be made of metal and plastic laminate which enables it to also serve to reduce or eliminate side lobes as an additional useful function.

Therefore it is an object of the invention to provide an improved stressed skin microwave antenna reflector structure of low weight, complexity, and cost.

Another object of the invention is to provide an antenna reflector of improved efficiency and greater accuracy of its reflector surface.

Another object of the invention is to provide limited remote control of antenna beam azimuth angle by movement of antenna feed along the focal plane.

Yet another object of the invention is to provide an inflatable antenna capable of being easily erected and deflatable to facilitate shipment.

Still another object of the invention is to provide an integral cover for the reflector to prevent reflector damage, exclude sunlight, rain and snow, and make a convex lenslike semistreamlined shape supported at its center of gravity to reduce the effect of wind.

BRIEF DESCRIPTION OF THE DRAWINGS

FIG. 1 is a cross-section of the inflatable antenna assembly with beam pointed 90° from horizontal.

FIG. 2 is a plan view of the inflatable antenna of FIG. 1.

FIG. 3 is an enlarged partial section of FIG. 1 showing central support member, trunnion tube, reflector, and cover.

FIG. 4 is a schematic diagram of the optical properties of a spherical reflector showing a first ray parallel to the central axis and a second ray diverging by a small angle from this axis, and how the focal point of the second ray is displaced along the focal plane from the axial focal point of the first ray.

DESCRIPTION OF THE PREFERRED EMBODIMENT

With reference to FIG. 1, a pipe frame 11 carries two bearings 12 fitting the outside diameter of a plastic trunnion tube 13. The ends of the trunnion tube 13 extend through the bearings 12 and carry a linear scale 14 on one end and a flat circular angle dial scale 15 on the other end. One bearing 12 next to angle dial 15 carries a vernier indicator 16, used with dial 15 to indicate elevation angle of the antenna beam. The trunnion tube 13 extends through the short cylindrical central equatorial support member 17 as shown in FIGS. 1, 2 and 3, and is joined to member 17 as shown in FIG. 1 and in the enlarged cross-section of FIG. 3. An accurately shaped laminated plastic sheet reflector 18 with metallic microwave reflecting coating 19 on its inside is joined to support member 17 at its periphery and held by bolts 23 through clamp ring 22 as shown in FIG. 3. A shaped laminated plastic sheet cover 20 with a layer of teflon 21 on its outside is joined to support member 17 at its periphery, held by clamp ring 22 and bolts 23. Cover 20 is transparent to microwaves, but opaque to sunlight. The thin external lamination of teflon sheds rain, snow and ice and prevents their accumulation. Bearings 12 are provided with set screws 24 to lock the trunnion tube 13 at the desired antenna elevation angle. Other methods of locking the bearings and trunnions may be employed, if desired. The central support member 17 is provided with a pneumatic tire valve 25 shown in FIG. 3 which enables pumping air into the sealed interior of the reflector and cover assembly which is made airtight. An angle collar 26 is held on trunnion tube 13 by clamp ring 27 and is fastened to support member 17 by bolts 28. Joints are gasketed. The trunnion tube hollow interior carries the antenna feed element 29 at the focal plane of reflector 18 for reception of microwave signals. Feed 29 is coupled to a low noise amplifier 30. A stiff coaxial cable 31 conveys the amplified microwave signal from amplifier 30 to a second low noise amplifier 32. Cable 31 can slide in locating spacers 33. A small wire inside the sheath of cable 31 can supply power to amplifier 30. A flexible coaxial cable 34 carries the signal output of amplifier 32 to the microwave receiver, not shown. By adjustment of the position of amplifier 32 with reference to the scale 14, the antenna feed 29 may be moved along the focal plane to swing the antenna beam reception angle, for example, as when receiving different stationary communication satellites along the earth's equatorial plane, when the reflector 18 is spherically shaped. If reflector 18 is parabolically shaped, the antenna feed 29 must be at the prime focus on the axis of the reflector, and the direction of frame 11 steered to swing the antenna beam azimuth angle. The optical schematic diagram of FIG. 4 graphically shows the displacement of the focal point 35 along the focal plane 36 of a ray 37 diverging by a small angle from the axis 38 of a spherical reflector 39 of spherical radius "$\gamma$" to show how the antenna beam can be swung through a limited azimuth angle by movement of the antenna feed 29 along the focal plane 36 from axial point 40 for an axial ray to point 35. The reflector 18 may be composed of pie shaped segments of material formed and joined in a highly accurate hollow mold having the spherical or parabolic shape and size desired, or may be formed of a single sheet of a suitable thermoplastic. The cover 20 may be similarly formed. The focal plane of a spherical reflector is R/2 where "R" is the spherical radius of the reflector. The equation ($Y=0.033\ x^2$) approximates the equation of a parabolic reflector of equal diameter which has its prime focus in the same focal plane as the spherical reflector. As the parabolic reflector is somewhat flatter than the spherical reflector, the central support member 17 must be made longer. The thin laminated plastic sheet material for reflector and cover is chosen to be resistant to heat, cold and ultraviolet rays. All joints are made airtight by gasketing and cementing. The central support member 17 is preferably made of a stiff laminate of plastic and metal having requisite strength so that it forms a collar which prevents microwave spillover from the reflector causing side lobes and noise in reception. When deflated, reflector 18 and cover 20 can be stowed inside member 17 for compact packaging during shipment. The frame 11 can be easily assembled from locally obtainable materials and attached to bearings 12 by pipe screw joints as shown in FIG. 3. The antenna assembly is internally pressurized by pumping air through valve 25 to stress the skin and thus form a highly efficient, simple, light microwave antenna. The novel construction of the present invention is applicable to a large range of wavelengths in the microwave spectrum, and can serve for both transmitting and receiving by appropriate design of the antenna feed for both functions. Trunnion tube 13 may have an enlarged portion at its center to provide necessary space for a servo-ed antenna feed or transmitter-receiver switching.

While the preferred embodiment of the invention has been described, the form of the invention described should be considered as illustrative and not limiting the scope of the following claims:

I claim:

1. An improved inflatable microwave antenna said improvement comprising:

a central rigid cylindrical support member;

a microwave transparent, airtight, trunnion tube extending diametrically through opposite walls of said central member, said trunnion tube walls joined in an airtight manner to the walls of said central member and extending beyond the walls of said central member to form trunnions for for pivoting said central member;

a formed thin airtight spherically shaped reflector which is reflective to microwaves joined in an airtight manner to a first end of said central member;

a formed thin airtight cover which is transparent to microwaves joined in an airtight manner to the second end of said central member;

an antenna feed supported inside said trunnion tube at the focal plane of said reflector said feed movable in said focal plane and said feed connected to associated microwave equipment utilizing said antenna;

a pneumatic valve located to enable gaseous pressurization of the interior space enclosed by said reflective skin, said cover skin, said walls of said trunnion tube and said central member, said gaseous pressurization sufficiently exceeding external gaseous pressure to stress said reflective skin to its formed shape and to stress said cover skin to its formed shape, and a supporting frame carrying bearings fitting said trunnions.

2. The antenna of claim 1 wherein said bearings are provided with locking means to lock said trunnions against rotation in said bearings.

3. The antenna of claim 1 wherein one said trunnion carries an angle dial and its associated bearing carries a vernier indicator to be used wih said dial for indication of antenna elevation angle.

4. The antenna of claim 1 wherein the said reflector is a laminate of a plastic and a metal with desirable physical properties and reflective to microwaves.

5. The antenna of claim 1 wherein the said cover is a laminate of two plastics with desirable physical properties and transparent to microwaves.

6. The antenna of claim 1 wherein said rigid central support member is a laminate of plastic and metal with desirable physical properties.

7. An inflatable stressed skin microwave antenna including a reflector and an antenna feed, for forming a beam that is steerable about a first axis by rotation of the reflector about the first axis and that is steerable about a second axis perpendicular to the first axis by translation of the antenna feed in the focal plane of the reflector, said antenna comprising in combination:

a supporting frame;

a microwave-transparent airtight trunnion tube mounted on said supporting frame for rotation about the first axis;

a rigid hollow cylindrical support member having a first end and a second end, said trunnion tube extending diametrically within said support member to opposite walls of said support member, and affixed to said support member in an airtight manner;

an airtight dome-shaped reflector joined in an airtight manner to the first end of said support member;

an airtight dome-shaped cover joined in an airtight manner to the second end of said support member, whereby an airtight chamber is bounded by the space outside said trunnion tube but within said support member and between said cover and said reflector;

pneumatic means to pressurize said airtight chamber; and, an antenna feed mounted within said trunnion tube to rotate with said trunnion tube and mounted for translational motion axially within said trunnion tube, whereby translational motion of said antenna feed steers the beam about the second axis.

8. The antenna of claim 7 wherein said support member includes a stiff laminate of plastic and metal to reduce side lobes.

9. The antenna of claim 7 wherein said reflector further comprises a spherical reflective surface.

10. The antenna of claim 7 wherein said reflector further comprises a parabolic reflective surface.

11. A kit for constructing an inflatable stressed-skin microwave antenna including a reflector and an antenna feed for forming a beam that is steerable about a first axis by rotation of the reflector about the first axis and that is steerable about a second axis perpendicular to the first axis by translation of the antenna feed in the focal plane of the reflector, said kit comprising in combination:

frame elements adapted to be assembled to form a supporting frame for the antenna;

a microwave-transparent airtight trunnion tube adapted to be mounted on said supporting frame for rotation about the first axis;

a rigid hollow cylindrical support member having a first end and a second end, said trunnion tube of sufficient length to extend diametrically between the walls of said support member, and said trunnion tube adapted to be affixed to said support member in an airtight manner;

an airtight dome-shaped reflector adapted to be joined in an airtight manner to the first end of said support member;

an airtight dome-shaped cover adapted to be joined in an airtight manner to the second end of said support member, so that when said trunnion tube has been affixed to said support member and said reflector and said cover have been joined to said support member, an airtight chamber is formed which is bounded by the space outside said trunnion tube but within said support member and between said cover and said reflector;

pneumatic means to pressurize said airtight chamber; and, an antenna feed adapted to be mounted within said trunnion tube for rotation with said trunnion tube and adapted to be mounted for translational motion axially within said trunnion tube, whereby translational motion of said antenna feed when so mounted will steer the beam about the second axis.

12. The kit of claim 11 wherein said support member further includes a stiff laminate of plastic and metal, which aids in the reduction of side lobes.

13. The antenna of claim 11 wherein said reflector further comprises a spherical reflective surface.

14. The antenna of claim 11 wherein said reflector further comprises a parabolic reflective surface.

* * * * *